US010834488B2

(12) United States Patent
Rainer et al.

(10) Patent No.: US 10,834,488 B2
(45) Date of Patent: Nov. 10, 2020

(54) ACOUSTIC SPEAKER WITH TWO HEAD-TO-TAIL LOUDSPEAKERS FIXED TO AN INTERNAL FRAME

(71) Applicant: DEVIALET, Paris (FR)

(72) Inventors: Max Rainer, Paris (FR); Bertrand Gangloff, Paris (FR); Bérenger Roig, Paris (FR); Jérémy Beigeaud, Chessy (FR); Victor Chambon, Paris (FR)

(73) Assignee: DEVIALET, Paris (FR)

( * ) Notice: Subject to any disclaimer, the term of this patent is extended or adjusted under 35 U.S.C. 154(b) by 0 days.

(21) Appl. No.: 16/594,970

(22) Filed: Oct. 7, 2019

(65) Prior Publication Data

US 2020/0112778 A1 Apr. 9, 2020

(30) Foreign Application Priority Data

Oct. 8, 2018 (FR) ..... 18 59308

(51) Int. Cl.
*H04R 1/02* (2006.01)

(52) U.S. Cl.
CPC ..... *H04R 1/025* (2013.01); *H04R 1/026* (2013.01)

(58) Field of Classification Search
CPC ..... H04R 1/025; H04R 1/2896; H04R 1/026; H04R 1/2888; H04R 5/02; H04R 2201/029; H04R 9/022
See application file for complete search history.

(56) References Cited

U.S. PATENT DOCUMENTS 4,805,221 A 2/1989 Quaas
2006/0002569 A1* 1/2006 Dickie ..... H04R 1/403 381/89
2016/0337756 A1* 11/2016 Oliveira ..... H04R 9/022

FOREIGN PATENT DOCUMENTS

GB 2414620 A * 11/2005 ..... H04R 1/403

OTHER PUBLICATIONS

Devialet (Phantom Review—Forget Everything You Thought You Knew About Speaker Technology, Nov. 13, 2015) https://www.techhive.com/article/3004548/devialet-phantom-review-forget-everything-you-thought-you-knew-about-speaker-technology.html (Year: 2015).*
Jan Selley, Naim Mu-So Qb Review. "Can Naim make their Philosophy work at 600?" Jan. 30, 2016.
Michael Brown, Devialet Phantom Review: "Forget everything you thought you knew about speaker technology," Nov. 13, 2015.

* cited by examiner

*Primary Examiner* — Yogeshkumar Patel
(74) *Attorney, Agent, or Firm* — B. Aaron Schulman, Esq.; Stites & Harbison, PLLC

(57) ABSTRACT

An acoustic speaker (1), comprising:
a metal frame (3),
a plastic shell (5) fastened on the frame, the shell defining at least two openings (7A, 7B),
at these two loudspeakers (9A, 9B) arranged back-to-back along a transverse axis (T), the two loudspeakers respectively extending through the two openings.
The frame comprises an inner part (21) located transversely between the two loudspeakers and on which the two loudspeakers are fastened.

10 Claims, 8 Drawing Sheets

ACOUSTIC SPEAKER WITH TWO HEAD-TO-TAIL LOUDSPEAKERS FIXED TO AN INTERNAL FRAME

BACKGROUND OF THE INVENTION

Field of the Invention

Figure 1:
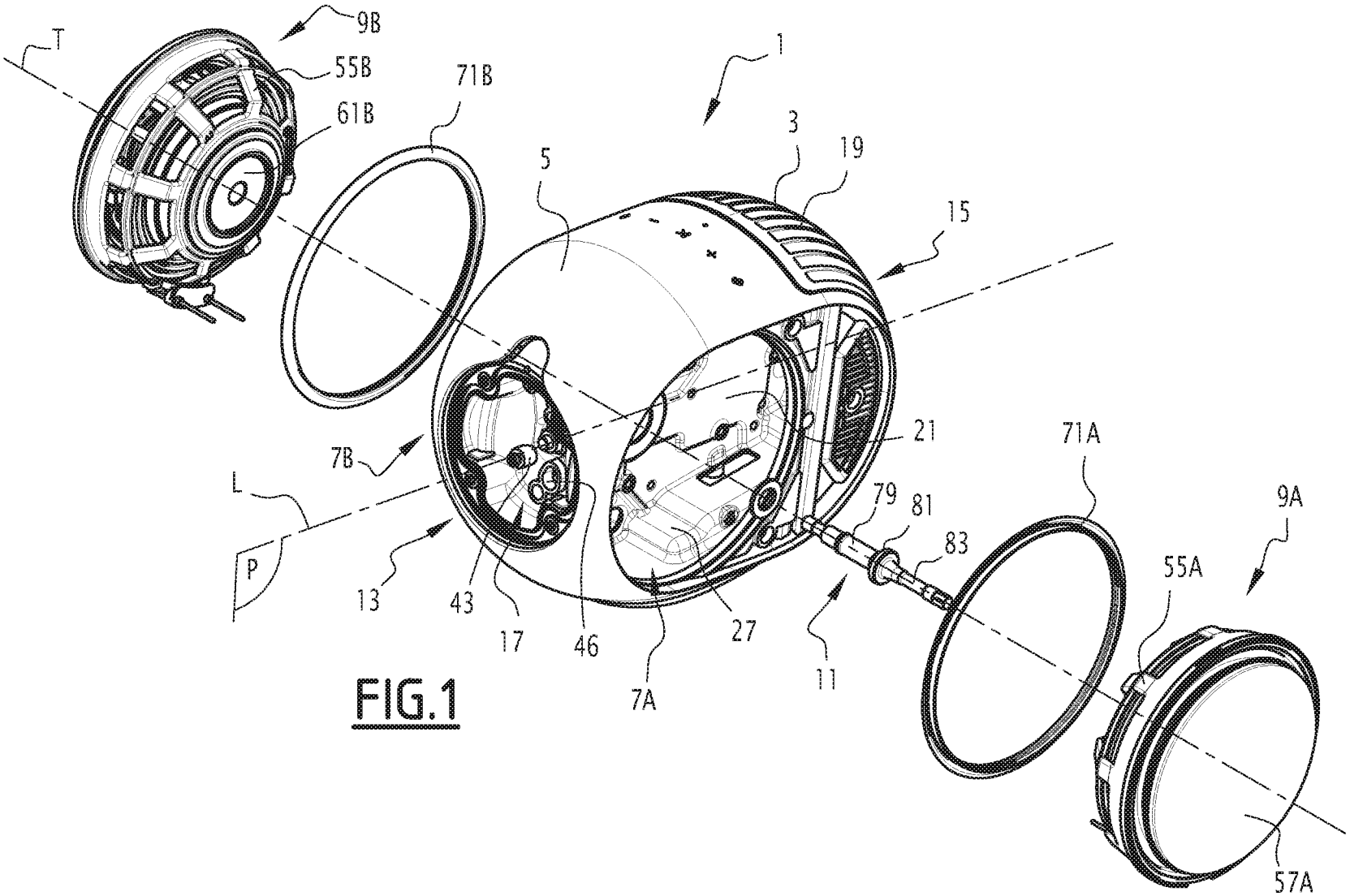

The present invention relates to an acoustic speaker comprising

- a metal frame,
- a plastic shell fixed to the frame, the shell defining at least two openings, and
- at least two loudspeakers arranged back-to-back along a transverse axis, the two loudspeakers respectively extending across the two openings.

Description of Related Art

The loudspeakers, in particular woofers, are bulky and heavy elements, likely to cause substantial vibrations of the acoustic speaker. They are therefore arranged head-to-tail so that the vibrations created by one cancel out those created by the other.

In order to assemble such acoustic speakers, the loudspeakers are first mounted on portions of the shell, on the inner side of the acoustic speaker. Then, the portions of the shell are assembled to one another and/or on a frame in a final position such that the two loudspeakers are head-to-tail. One advantage of such an architecture is that the loudspeakers stiffen the plastic perimeter of the openings through which they extend.

Nevertheless, the overall assembly is relatively complex, and traces remain of the assembly of the portions of the shell that are visible by a user, or sensitive to the touch. Such traces are detrimental to the smooth and clean appearance that one generally wishes to give the acoustic speaker. These traces are generally considered not to be esthetically pleasing.

One aim of the invention is therefore to provide an acoustic speaker that is less complex to assemble.

BRIEF SUMMARY OF THE INVENTION

To that end, the invention relates to an acoustic speaker of the type described above, in which the frame comprises an inner part located transversely between the two loudspeakers and on which the two loudspeakers are fixed.

According to specific embodiments, the acoustic speaker includes one or more of the following features, considered alone or according to any technically possible combination (s):

- the two loudspeakers are devoid of any rigid connection with the shell other than that formed by the frame;
- the shell is in one piece;
- the frame comprises an outer part forming a back part of the acoustic speaker along the longitudinal axis, the shell forming a front part of the acoustic speaker along the longitudinal axis, and the shell and the outer part of the frame are suitable for nesting one in the other along the longitudinal axis;
- the acoustic speaker comprises a fixing system suitable for fixing one of the two loudspeakers on the inner part, the first fixing system including: a first part passing through the inner part of the frame, and a second part located transversely on the other side of the inner part relative to said one of the two loudspeakers, the second part being mounted rotatably relative to the inner part around an axis parallel to the transverse axis between a blocking position, in which the inner part is sandwiched between said one of the two loudspeakers and the second part, and an unblocking position making it possible to remove said one of the two loudspeakers through one of the two openings, the second part being able to be actuated in rotation from said other side of the inner part in the absence of the other of said two loudspeakers;
- the first part of the fixing system comprises a shank of a screw, and the second part comprises a head of this screw;
- the second part of the fixing system includes an extension along the transverse axis engaged in a housing defined by the other of the two loudspeakers;
- at least one of the loudspeakers comprises a surface glued on the inner part of the frame;
- the shell defines an opening forming an access to said glued surface; and
- one of the two loudspeakers is fixed on the inner part of the frame by a fixing system comprising at least one dowel oriented perpendicular to the transverse axis and including a head accessible through at least one opening of the shell to move the dowel relative to the inner part of the frame between a blocking position of said one of the two loudspeakers, and an unblocking position making it possible to remove said one of the two loudspeakers through one of the two openings.

BRIEF DESCRIPTION OF THE SEVERAL VIEWS OF THE DRAWING(S)

Figure 3:
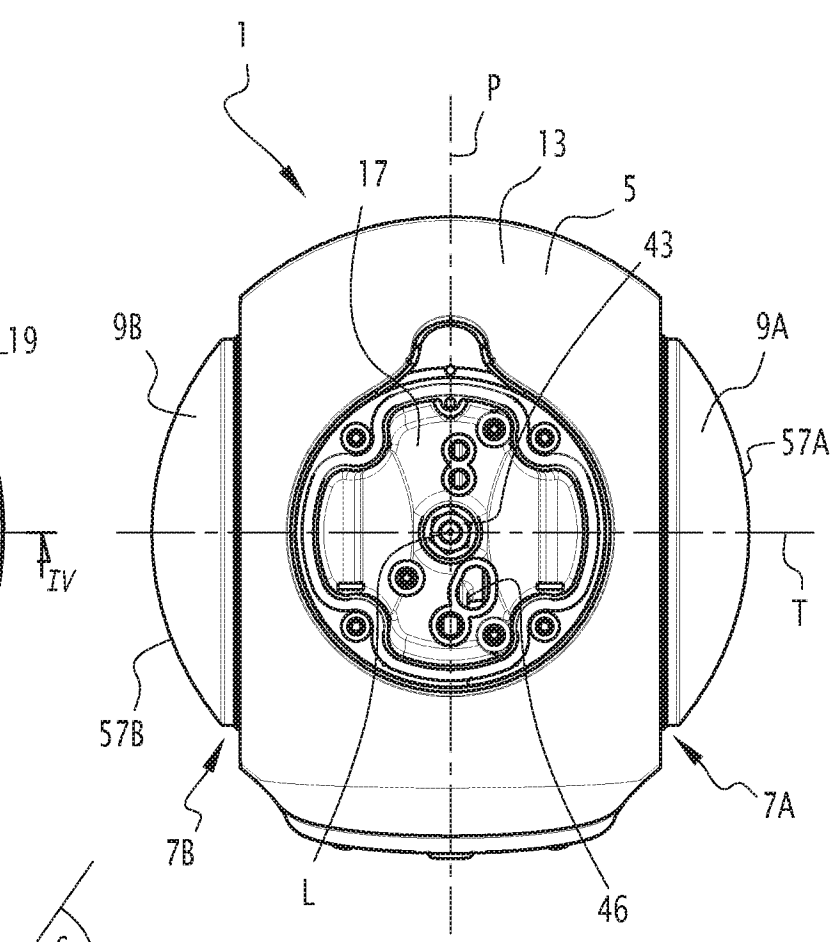
Figure 2:
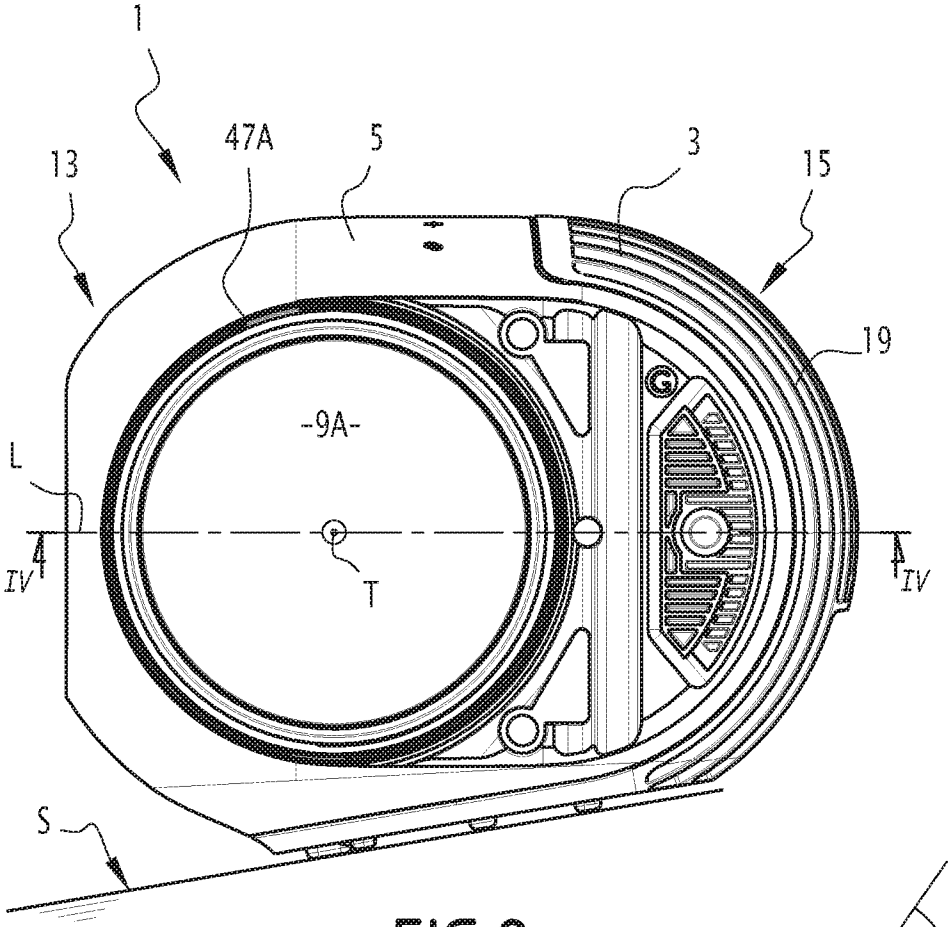
Figure 4:
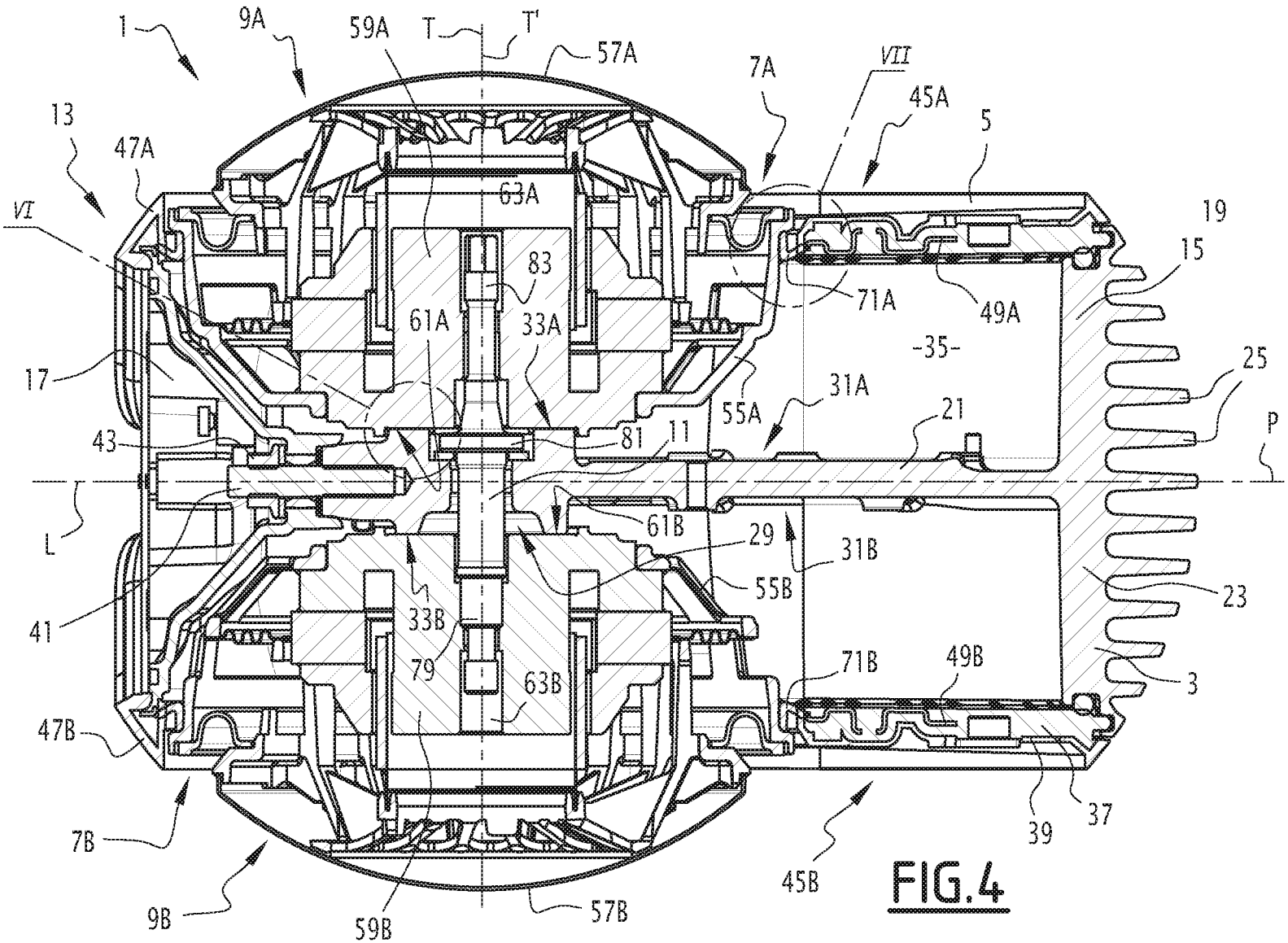
Figure 5:
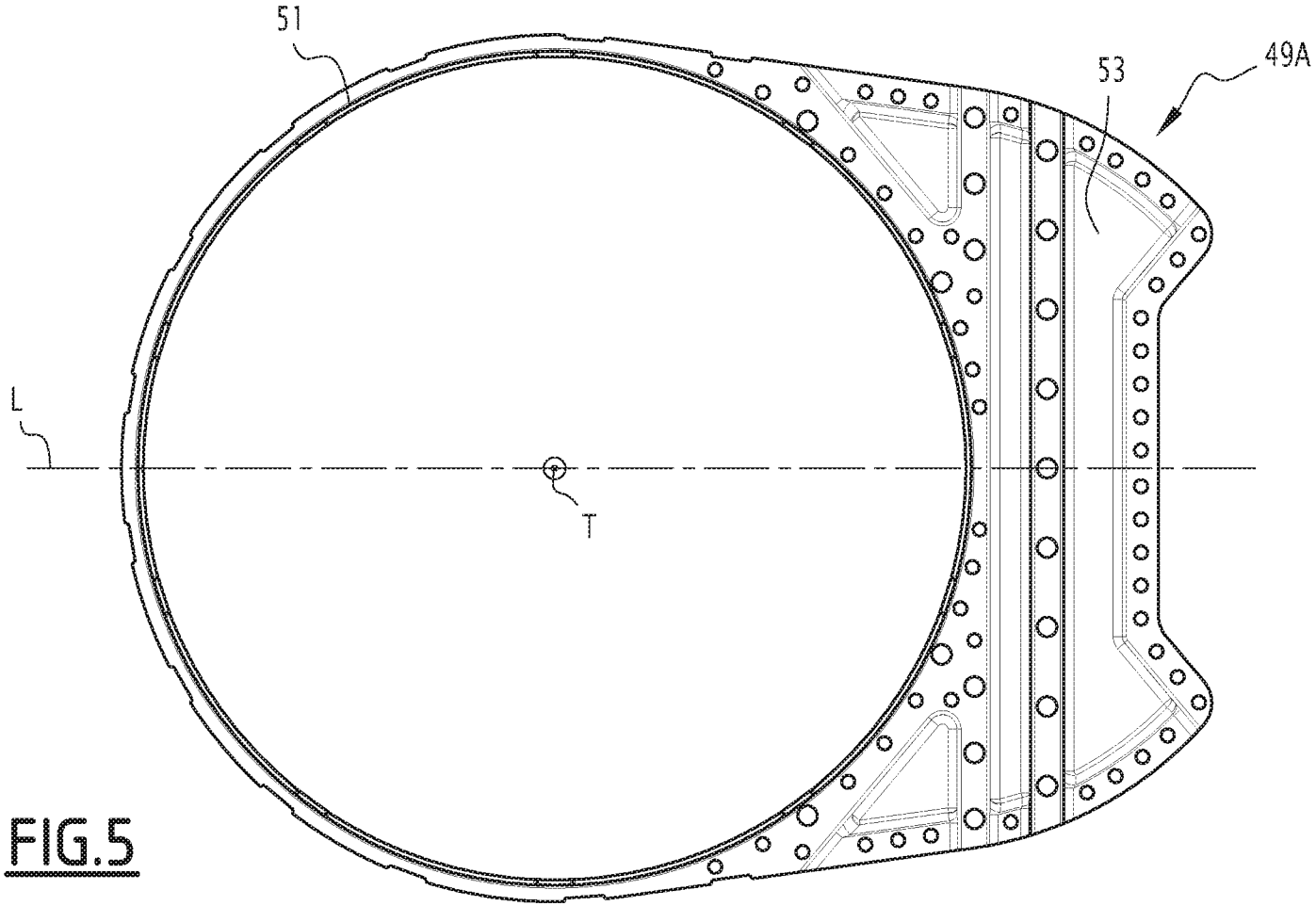
Figure 7:
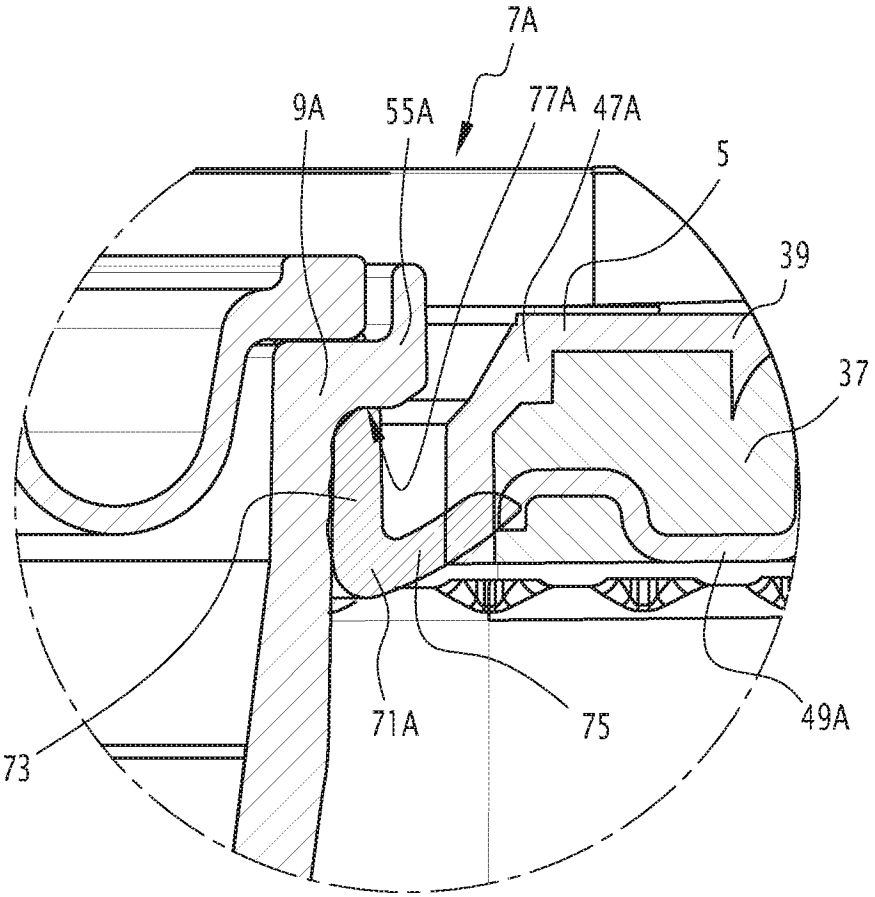
Figure 8:
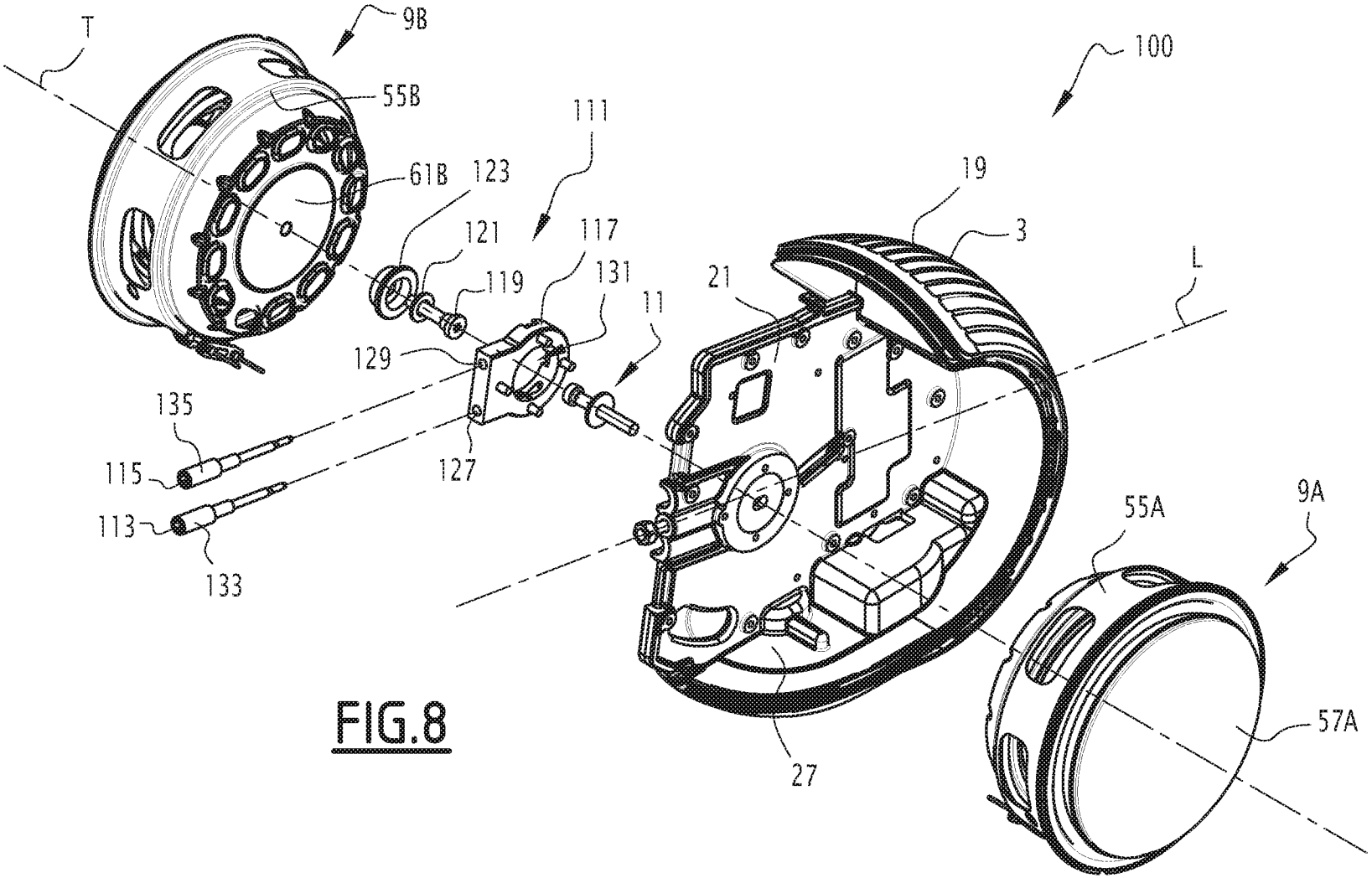
Figure 9:
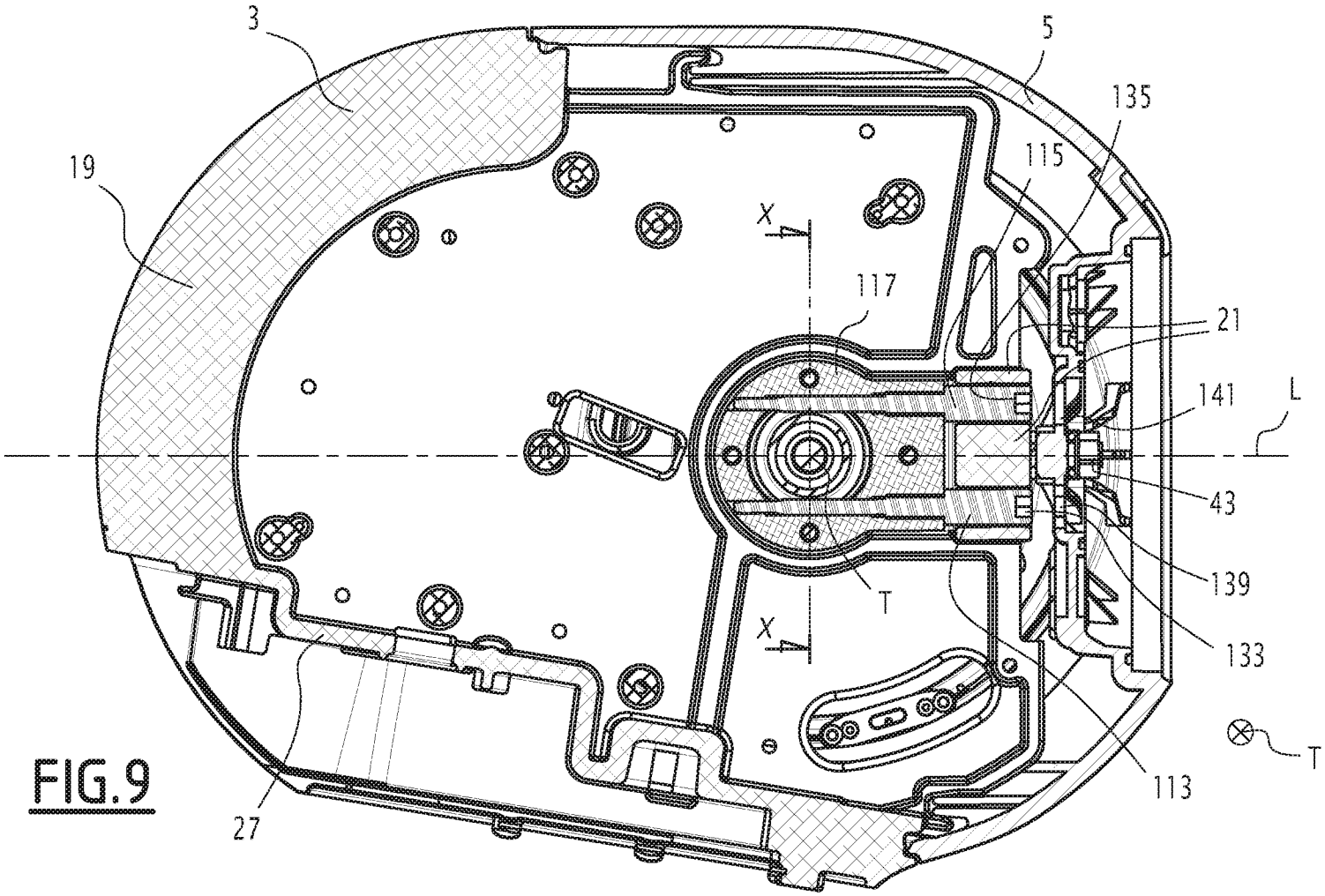
Figure 10:
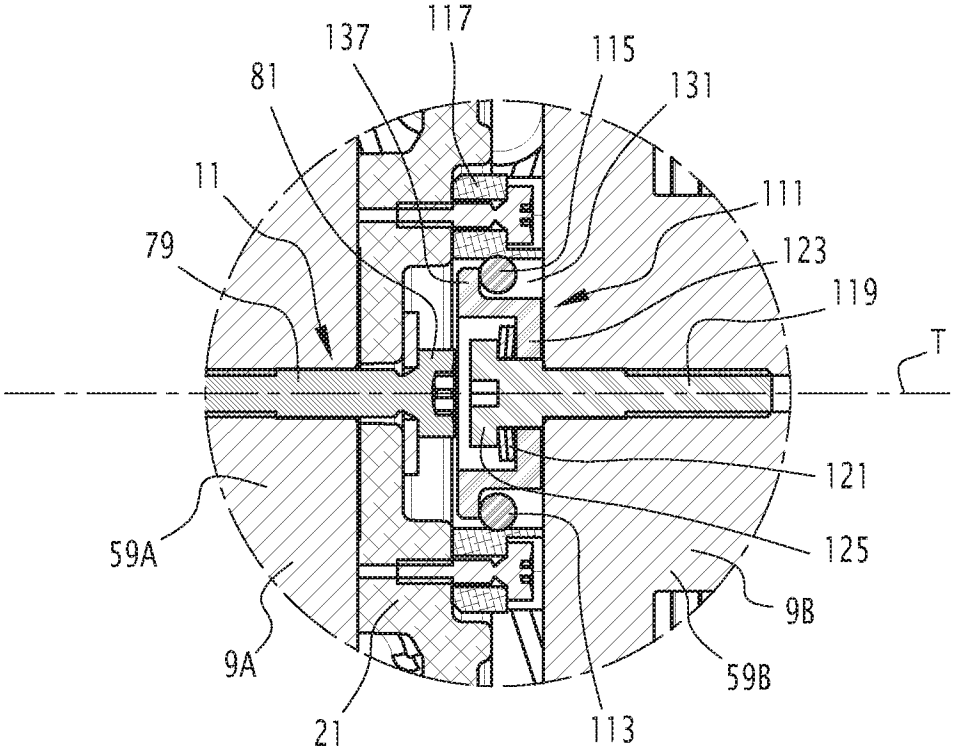

The invention will be better understood upon reading the following description, provided solely as an example, and in reference to the appended drawings, in which:

FIG. 1 is an exploded perspective view of an acoustic speaker according to the invention, FIGS. 2 and 3 are side and front views of the acoustic speaker shown in FIG. 1, FIG. 4 is a view of the acoustic speaker shown in FIGS. 1 to 3, in sectional view along a plane passing through the longitudinal axis defined by the acoustic speaker and by the transverse axis defined by the loudspeaker, FIG. 5 is a front view of a metallic insert present in two copies in the shell of the acoustic speaker shown in FIGS. 1 to 4, FIGS. 6 and 7 are detail views of FIG. 4, and are respectively centered on an adhesion zone of one of the loudspeakers, and on a sealing gasket of one of these loudspeakers, FIG. 8 is an exploded perspective view of an acoustic speaker making up a variant of the acoustic speaker shown in FIGS. 1 to 4, FIG. 9 is a view of the acoustic speaker shown in FIG. 8, in cross-section along a vertical median plane, and FIG. 10 is a detail view of the acoustic speaker shown in FIGS. 8 and 9, in cross-section in a plane perpendicular to the longitudinal axis and passing through the transverse axis defined by the loudspeakers.

DETAILED DESCRIPTION OF THE INVENTION

An acoustic speaker 1 according to the invention is described in reference to FIGS. 1 to 4.

The acoustic speaker 1 is for example an active speaker, that is to say, it in particular includes an audio signal reader and an amplifier (not shown). Likewise, for clarity reasons, other electrical or electronic elements of the acoustic speaker not directly related to the invention are not shown in the figures.

The acoustic speaker 1 comprises a metal frame 3, and a plastic shell 5 fixed on the frame and defining at least two openings 7A, 7B. The acoustic shell 1 comprises two loudspeakers 9A, 9B arranged back-to-back along a transverse axis T and respectively extending across the two openings 7A, 7B. The acoustic speaker comprises a fixing system 11 suitable for fixing the loudspeaker 9B on the frame 3, the loudspeaker 9A being, in the illustrated example, fixed more simply on this frame.

The transverse axis T is for example horizontal when the acoustic speaker is in the usage position on a horizontal surface S.

In the illustrated example, the acoustic speaker 1 is oblong along a longitudinal axis L that is advantageously perpendicular to the transverse axis T. Thus, the acoustic speaker 1 includes a front part 13 formed by the shell 5, and a rear part 15 formed by the frame 3.

Advantageously, the acoustic speaker 1 comprises a third loudspeaker (not shown) fixed in a housing 17 defined by the shell 5.

The acoustic speaker for example has an outer shape that is symmetrical relative to a plane P perpendicular to the transverse axis T and passing through the longitudinal axis L.

The frame 3 is for example a foundry part, advantageously made from aluminum.

The frame 3 comprises an outer part 19 forming the back part 15 of the acoustic speaker and suitable for nesting with the shell 5, for example along the longitudinal axis L. The frame 3 also comprises an inner part 21 extending between the two loudspeakers 9A, 9B along the plane P and on which the two loudspeakers are rigidly fixed.

"Rigidly fixed" here refers to a solid mechanical fixing, also for example resisting a tear strength of 100 N (newton), preferably 1000 N.

The outer part 19 comprises a back portion 23 (FIG. 4) defining a plurality of fins 25 for discharging the heat generated inside the acoustic speaker, and a soleplate 27 extending longitudinally below the loudspeakers 9A, 9B from the back portion 23.

The inner part 21 for example has a generally planar shape. The inner part 21 is advantageously integral with the back portion 23 and the soleplate 27. The inner part 21 defines an axial passage 29 passed through by the fastening system 11.

On a first face 31A oriented transversely toward the loudspeaker 9A, the inner part defines a receiving surface 33A of the loudspeaker 9A. On a second face 31B oriented transversely toward the loudspeaker 9B, the inner part defines a receiving surface 33B of the loudspeaker 98.

The receiving surfaces 33A, 33B are advantageously perpendicular to the transverse axis T. The receiving surfaces advantageously completely surround the transverse axis T and for example have an annular shape. The receiving surfaces form transverse protuberances of the inner part 21, respectively on the first face 31A and on the second face 31B.

The shell 5 is advantageously in one piece. "One piece" means that the shell is in a single piece and is not made up of portions mechanically fixed on one another.

The shell 5 defines, with the outer part 19 of the frame, an inner volume 35 of the acoustic speaker in which the loudspeakers 9A and 9B are inserted in large part.

The shell 5 comprises an inner layer 37 for example comprising polycarbonate (PC) and between 15% and 25% by weight of glass fibers, and an outer layer 39, or trim layer, for example including acrylonitrile butadiene styrene (ABS).

The shell is rigidly fixed on the inner part 21 of the frame, for example using a dowel 41 screwed longitudinally into the edge of the inner part 21, and a nut 43 screwed on the dowel to press the shell longitudinally against the inner part.

The shell is not rigidly connected to the two loudspeakers 9A, 9B except by means of the frame 3. The shell is suitable for allowing an insertion of the loudspeakers 9A, 9B along the transverse axis T respectively through the openings 7A, 7B to the inner part 21 of the frame.

The shell comprises two back parts 45A, 45B respectively located longitudinally between the loudspeakers 9A, 9B and the back portion 23 of the frame.

The shell advantageously defines an opening 46 for accessing the loudspeakers 9A.

The opening 46 is advantageously located in the housing 17 and hidden by the third loudspeaker (not shown).

The inner layer 37 delimits the inner volume 35.

The openings 7A, 7B are advantageously circular and for example centered on the transverse axis T. The openings 7A, 7B are respectively delimited by two edges 47A, 47B of the shell.

The edge 47A and the back wall 45A are stiffened by a metal insert 49A.

The edge 49B and the back wall 45B are stiffened by a metal insert 49B that is advantageously structurally similar to the metal insert 49A.

The two inserts being structurally similar, only the insert 49A will be briefly described in reference to FIG. 5.

The insert 49A is overmolded by the inner layer 37 of the shell. The metal insert 49A comprises a circular part 51 located in the edge 47A to stiffen the latter, and a part 53 longitudinally adjacent to the circular part 51 and located in the back wall 45A.

The loudspeakers 9A, 9B are for example woofers. "Woofers" for example refer to loudspeakers suitable for diffusing acoustic waves with frequencies lower than 1000 Hz, preferably lower than 500 Hz, still more preferably lower than 150 Hz.

The loudspeakers 9A, 9B respectively comprise a chassis 55A, 55B (FIG. 4), a membrane 57A, 57B suitable for emitting sound waves, and a magnetic circuit 59A, 59B.

The membranes 57A, 57B are advantageously spherical caps. The membranes are not interrupted at the transverse axis T, since the loudspeakers 9A, 9B are fixed on the inner part 21 by their sides transversely opposite the membranes.

The magnetic circuits 59A, 59B are fixed on the inner part 21 of the frame. The magnetic circuits 59A, 59B respectively define surfaces 61A, 61B in contact with the reception surfaces 33A, 33B of the frame. The magnetic circuits respectively define an axial housing 63A, 63B emerging at least on the side of the inner part 21 of the frame.

Figure 6:
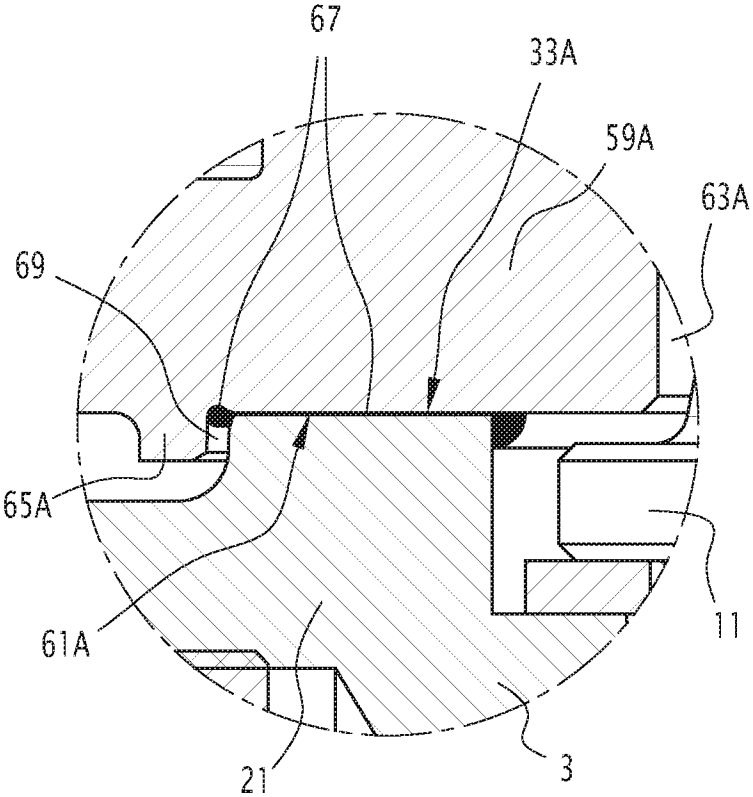

As shown in FIG. 6, the surface 61A is delimited radially from the transverse axis T by a rim 65A formed by the magnetic circuit 59A.

The surface 33A is for example glued on the reception surface 61A using a glue 67.

Advantageously, the rim 65A and the protuberance of the inner part 21 forming the reception surface 33A together define a housing 69 in which an overflow of glue 67 is present, which reinforces the cohesion between the magnetic circuit 59A and the inner part 21 of the frame.

In the example, the chasses 55A, 55B are fixed on the magnetic circuits 59A, 59B and are not fixed directly on the frame.

The chasses 55A, 55B are not rigidly fixed on the shell 5 except by means of the magnetic motors and the frame 3. In other words, the chasses of the loudspeakers 9A, 9B are cantilevered relative to the edges 47A, 47B of the shell.

As shown in FIG. 7, the sealing gaskets 71A, 71B are respectively arranged between the loudspeakers 9A, 9B and the edges 47A, 47B of the shell. However, these seals do not make up a rigid connection between the loudspeakers 9A, 9B and the shell.

The sealing gaskets 71A and 71B being structurally identical to one another and symmetrical to one another relative to the plane P, only the seal 71A will be described hereinafter.

The seal 71A comprises a main part 73 resiliently gripping the chassis 55A around the transverse axis T, and a lip 75 bearing on the edge 47A of the shell.

The main part 73 abuts transversely against a shoulder 77A formed by the chassis 55A.

The lip 75 is bent transversely on the outer side of the acoustic speaker.

This configuration of the seal 71A allows an easy insertion of the loudspeaker 9A into the inner volume 35 through the opening 7A.

The fastening system 11 comprises a first part 79 passing axially through the inner part 21 of the frame via the passage 29, and a second part 81 located transversely on the other side of the first part 21 relative to the loudspeaker 9B.

In the illustrated example, the first part 79 is a screw shank, and the second part comprises a head of this screw and a washer.

The first part 79, that is to say, the screw shank, is screwed in the housing 63B formed by the magnetic circuit 59B of the loudspeaker 9B.

The second part 81, that is to say, the screw head, is mounted rotating relative to the inner part 21 around an axis T' that is, in the example, the transverse axis T, between a position blocking the loudspeaker 9B, and an unblocking position making it possible to remove the loudspeaker 9B through the opening 7B.

In the blocking position, shown in FIG. 4, the inner part 21 is sandwiched axially between the loudspeaker 9B and the second part 81.

In the unblocking position, the first part 79 is unscrewed from the magnetic circuit 59B, which frees the loudspeaker 9B, which can be removed from the inner volume 35 by a translation along the transverse axis T.

The second part 81, that is to say, the screw head, can be actuated in rotation around the axis T' from the side of the inner part 21 opposite the loudspeaker 9B in the absence of the loudspeaker 9A.

In the illustrated example, the second part 81 includes a transverse extension 83 engaged in the housing 63A defined by the loudspeaker 9A. This makes it possible to guide the movement of the loudspeaker 9A when the latter is introduced into the inner volume 35 to be glued on the reception surface 33A of the frame.

According to a variant that is not shown, the fastening system 11 includes a dowel secured to the loudspeaker 9B and passing through the passage 29, and a nut screwed on the dowel from the side of the inner part 21 transversely opposite the loudspeaker 9B.

The assembly of the acoustic speaker 1 will now be briefly described.

After having fixed electronic elements, not shown, on the frame, the shell 5 and the frame 3 are nested one in the other along the longitudinal axis L. The shell is then fixed on the frame by screwing the nut 43 on the dowel 41.

The loudspeaker 9B is then introduced along the transverse axis T into the inner volume 35 via the opening 7B.

From the other side of the inner part 21, which is not yet occupied by the loudspeaker 9A, the fastening system 11 is introduced into the passage 29. The first part 79 is screwed into the housing 63B until the second part 81 abuts against the inner part 21. The surface 61B of the magnetic circuit 59B is then kept firmly in contact with the reception surface 33B of the inner part. The screwing operation of the fastening system 11 is easily carried out from the side of the inner part 21 that is not yet occupied by the loudspeaker 9A.

Next, the reception surface 33A and/or the surface 61A of the magnetic surface 59A are coated with glue 67. The loudspeaker 9A is then introduced into the inner volume 35 via the opening 7A of the shell. The extension 83 of the second part 81 enters into the housing 63A defined by the magnetic circuit 59A, which makes it possible to guide the movement of the loudspeaker 9A. The surface 61A and the reception surface 33A are next kept in contact with one another. An overflow of glue 67 flows into the housing 69. The drying takes place. The loudspeaker 9A is in turn solidly fixed on the inner part 21 of the frame.

For any disassembly of the loudspeakers, the access opening 46 defined by the shell is used to insert a suitable tool (not shown) to loosen the loudspeaker 9A from the inner part 21. The loudspeaker 9A can then be removed along the transverse axis T. Once the loudspeaker 9A is removed, the fastening system 11 becomes accessible through the opening 7A. It is then possible to rotate the second part 81 in order to unscrew the first part 79 and release the loudspeaker 9B. The loudspeaker 9B can then be removed along the transverse axis T through the opening 7B.

Owing to the features described above, the acoustic speaker 1 is easy to assemble and disassemble, despite the one-piece nature of its shell 5.

In reference to FIGS. 8 to 10, we will now describe an acoustic speaker 100 that makes up a variant of the acoustic speaker 1. The acoustic speaker 100 is similar to the acoustic speaker 1 shown in FIGS. 1 to 7. The similar elements bear the same numerical references that will not described again. Only the notable differences will be described below.

The acoustic speaker 100 differs by the fastening mode of the loudspeakers 9A, 9B.

The loudspeaker 9A of the acoustic speaker 100 is fixed by screwing in a manner similar to the loudspeaker 9B of the acoustic speaker 1. As shown in FIG. 10, the fastening system 11 rigidly fixes the loudspeaker 9A on the inner part 21. The first part 79 is screwed into the magnetic circuit 59A, and the second part 81 makes it possible to screw the first part from the side of the inner part 21 opposite the loudspeaker 9A.

The second part 81 is devoid of the extension 83 present in the acoustic speaker 1.

The loudspeaker 9B is fixed on the inner part 21 by a fastening system 111 that does not involve gluing the loudspeaker 9B on the inner part 21.

The fastening system 111 comprises two dowels 113, 115 making it possible to block or unblock the loudspeaker 9B relative to the inner part 21.

According to a variant that is not shown, the fastening system 111 is configured to include only one dowel.

The fastening system 111 comprises a support block 117 to guide the dowels 113, 115 longitudinally, a washer head screw 119 screwed axially into the magnetic circuit 59B of the loudspeaker 9B, a lock washer 121, and a connecting piece 123 that are slipped on the washer head screw 119.

The lock washer 121 is compressed transversely between the connecting piece 123 and a head 125 of the washer head screw 119. The lock washer 121 has a high stiffness.

In a variant (not shown), several lock washers are arranged in series between the connecting piece 123 and the head 125.

The support block 117 is fastened on the inner part 21 of the frame on the side of the loudspeaker 9B, for example by screws. The support block defines two longitudinal passages 127, 129 for the dowels 113, 115, and a housing 131 in which the screw head 125, the lock washer 121 and the connecting piece 123 are located.

The dowels 113, 115 for example have a spindle-shaped profile with a diameter increasing gradually in the longitudinal direction toward their heads 133 to 135 so as to gradually compress the lock washers 121 and facilitate the assembly of the system.

The connecting piece 123 includes a rim 137 forming a transverse stop for the dowels 113, 115.

When the dowels 113, 115 are screwed into the support block 117, the dowels push the connecting piece 123 along the transverse axis T toward the inner part 21 of the frame, which results in further compressing the lock washer 121 between the screw head 125 and the connecting piece 123. Thus, the resilient force applied by the lock washer 121 on the screw head 125 keeps the magnetic circuit 59B firmly against the support block 117, thus fastening the loudspeaker 9B on the inner part 21.

The loudspeaker 9B is rigidly fastened on the inner part 21, in that a tear strength must overcome the stiffness of the lock washer 121 to move the magnetic circuit 59B away from the support block 117. Furthermore, the loudspeaker 9B is brought back toward the support block once this force ceases.

In a variant, the dowels 113, 115 are screwed into the inner part 21 of the frame, and the support block 117 is advantageously eliminated.

Advantageously, the shell 5 defines two openings 139, 141 in order to access the heads 133, 135 of the dowels from the outside of the shell.

These access openings are advantageously hidden by the third loudspeaker.

The invention claimed is:

1. An acoustic speaker, comprising:

a metal frame, a plastic shell fastened on the frame, the plastic shell defining at least two openings, and at least two loudspeakers arranged back-to-back along a transverse axis, the at least two loudspeakers respectively extending across the at least two openings, wherein the frame comprises an inner part located transversely between the at least two loudspeakers and on which the at least two loudspeakers are fastened.

2. The acoustic speaker according to claim 1, wherein the at least two loudspeakers are devoid of any rigid connection with the plastic shell other than that formed by the frame.

3. The acoustic speaker according to claim 1, wherein the plastic shell is in one piece.

4. The acoustic speaker according to claim 1, wherein:

the frame comprises an outer part forming a back part of the acoustic speaker along a longitudinal axis, the plastic shell forming a front part of the acoustic speaker along the longitudinal axis, and the plastic shell and the outer part of the frame are suitable for nesting one in the other along the longitudinal axis.

5. The acoustic speaker according to claim 1, comprising a fastening system for fastening one of the at least two loudspeakers on the inner part, the first fastening system including:

a first part passing through the inner part of the frame, and a second part located transversely on the other side of the inner part relative to said one of the at least two loudspeakers, the second part being mounted rotatably relative to the inner part around an axis parallel to the transverse axis between a blocking position, in which the inner part is sandwiched between said one of the at least two loudspeakers and the second part, and an unblocking position making it possible to remove said one of the at least two loudspeakers through one of the at least two openings, the second part being able to be actuated in rotation from said other side of the inner part in the absence of the other of said at least two loudspeakers.

6. The acoustic speaker according to claim 5, wherein the first part of the fixing system comprises a shank of a screw, and the second part comprises a head of this screw.

7. The acoustic speaker according to claim 5, wherein the second part of the fastening system includes an extension along the transverse axis engaged in a housing defined by the other of the at least two loudspeakers.

8. The acoustic speaker according to claim 1, wherein at least one of the at least two loudspeakers comprises a surface glued on the inner part of the frame.

9. The acoustic speaker according to claim 8, wherein the plastic shell defines an opening forming an access to said glued surface.

10. The acoustic speaker according to claim 1, wherein one of the at least two loudspeakers is fixed on the inner part of the frame by a fastening system comprising at least one dowel oriented perpendicular to the transverse axis and including a head accessible through at least one of the at least two openings of the plastic shell to move the dowel relative to the inner part of the frame between a blocking position of said one of the at least two loudspeakers, and an unblocking position making it possible to remove said one of the at least two loudspeakers through one of the at least two openings.

* * * * *